US009706851B2

(12) United States Patent
Malkiewicz et al.

(10) Patent No.: US 9,706,851 B2
(45) Date of Patent: Jul. 18, 2017

(54) MATTRESS CORE

(71) Applicants: James Malkiewicz, Sacramento, CA (US); Michael Malkiewicz, San Diego, CA (US)

(72) Inventors: James Malkiewicz, Sacramento, CA (US); Michael Malkiewicz, San Diego, CA (US)

( * ) Notice: Subject to any disclaimer, the term of this patent is extended or adjusted under 35 U.S.C. 154(b) by 216 days.

(21) Appl. No.: 14/812,764

(22) Filed: Jul. 29, 2015

(65) Prior Publication Data

US 2016/0029810 A1 Feb. 4, 2016

Related U.S. Application Data

(60) Provisional application No. 62/030,800, filed on Jul. 30, 2014.

(51) Int. Cl.

| | |
|---|---|
| ***A47C 27/14*** | (2006.01) |
| ***A47C 21/04*** | (2006.01) |
| ***A47C 23/00*** | (2006.01) |
| ***A47C 27/20*** | (2006.01) |

(52) U.S. Cl.

CPC ..... *A47C 27/144* (2013.01); *A47C 21/046* (2013.01); *A47C 23/002* (2013.01); *A47C 27/142* (2013.01); *A47C 27/148* (2013.01); *A47C 27/20* (2013.01)

(58) Field of Classification Search

CPC ..... A47C 27/14; A47C 27/142; A47C 27/144; A47C 27/146; A47C 27/148; A47C 27/15; A47C 27/20; A47C 21/046; A47C 23/002; A61G 7/05707

See application file for complete search history.

(56) References Cited

U.S. PATENT DOCUMENTS 3,251,076 A * 5/1966 Burke ..... F16F 1/376 188/268
3,866,252 A * 2/1975 Rogers, Jr. ..... A47C 27/088 5/655.9
4,194,255 A * 3/1980 Poppe ..... A47C 27/065 267/153
4,866,800 A * 9/1989 Bedford ..... A61G 7/05784 5/652.1
5,153,956 A * 10/1992 Nold ..... A61G 7/05707 428/218
5,325,552 A * 7/1994 Fong ..... A47C 27/05 5/724
5,353,455 A * 10/1994 Loving ..... A47C 23/002 29/451
5,850,648 A * 12/1998 Morson ..... A47C 21/046 5/724

(Continued)

*Primary Examiner* — Robert G Santos
*Assistant Examiner* — David R Hare
(74) *Attorney, Agent, or Firm* — Eric Hanscom; Todd J. Langford

(57) ABSTRACT

This invention is a mattress core that is manufactured as a single unit. It is made up of individual cones that have different configurations resulting in different densities at different portions of the mattress. There are three main ways to accomplishing this goal: columns of different sizes and shapes, columns with different hole diameters, and columns with different density foam used to create them. A key advantage of this invention is that it is a single mattress made from a single mold, and does not require multiple parts to be put together.

12 Claims, 12 Drawing Sheets

(56) References Cited

U.S. PATENT DOCUMENTS

| | | | | |
|---|---|---|---|---|
| 6,551,450 | B1 * | 4/2003 | Thomas | A61H 9/0078 156/580.1 |
| 7,120,956 | B1 * | 10/2006 | Liao | A47C 23/002 5/718 |
| 7,520,011 | B1 * | 4/2009 | Liberkowski | A47C 23/002 5/719 |
| 7,571,504 | B2 * | 8/2009 | Kuo | A47C 27/144 5/690 |
| D606,794 | S * | 12/2009 | Steppat | D6/606 |
| 7,685,663 | B2 * | 3/2010 | Rawls-Meehan | A47C 7/027 5/719 |
| D647,350 | S * | 10/2011 | Mantzis | D6/601 |
| 8,628,067 | B2 * | 1/2014 | Pearce | A47C 27/144 267/142 |
| 9,032,571 | B2 * | 5/2015 | Rancourt | A47C 23/002 5/652 |
| 9,510,690 | B2 * | 12/2016 | Rawls-Meehan | A47C 7/14 |
| 2006/0162087 | A1 * | 7/2006 | Chang | A47C 27/20 5/724 |
| 2010/0218318 | A1 * | 9/2010 | Steppat | A47C 27/144 5/690 |
| 2011/0072587 | A1 * | 3/2011 | Cao | A47C 17/70 5/655.9 |

* cited by examiner

MATTRESS CORE

CROSS REFERENCE TO RELATED APPLICATIONS

This application claims priority back to U.S. Provisional No. 62/030,800, filed Jul. 30, 2014, the contents of which are incorporated by reference.

STATEMENT REGARDING FEDERALLY SPONSORED RESEARCH OR DEVELOPMENT

This invention was not federally sponsored.

LIST OF REFERENCE NUMBERS

1. Mattress core
2. Top Edge
3. Side Edge
4. Side Channels for Air Flow
5. Bottom Edge
6. Column
7. Main Mattress Body
8. Foot
9. Hole
10. Bulb
11. Base
12. Connector
13. Column Height
14. Main mattress body
15. Mattress bottom
16. Column width
17. Foot generally
18. Foot side
19. Foot top
20. Foot hole

BACKGROUND OF THE INVENTION

Field of the Invention

This invention relates to the general field of mattresses, and more particularly to mattress core manufactured with a number of individual, resilient elements, generally referred to as columns. To this end, a mattress with a large number of individual resilient members is described. The height and amount of resiliency are varied among the columns to give the mattress different densities at different parts of the mattress.

It is desirable to be able to manufacture a mattress where different regions of the mattress have different degrees of firmness. Since humans are not built flat, it is desirable to have a mattress that has denser regions near the person's midsection, where the bulk of a person's weight is located.

A problem with traditional coiled wire mattresses is that while it is possible to insert springs of different degrees of compressibility, it is expensive to do so. While coil mattresses have been around since the 1800's, the last major innovation in spring mattresses occurred in the 1950's with the continuous coil. Thus, many consumers are looking for a more modern, innovative product. Additionally, mattresses are a major problem in landfills. Mattresses with springs are very difficult to take apart to take up less room in a landfill, and many states and local governments are passing laws several restricting and otherwise regulating the disposal of mattresses. The "pocketed coil" is the most popular spring mattress on the market today, and has a spring coil that is covered with fabric. This is extremely difficult to dispose of, as the fabric needs to be removed by hand from each coil before recycle, thus it is very labor-intensive as there are no recycling machines capable of shredding and sorting a spring mattress.

The different components of a coil mattress also make it illegal to dispose of them through incineration in many states. Smokestacks in incinerators have different scrubbers to remove different pollutants, and the pollutants from fabric, foam, wood and steel are very different. Thus, you can't just throw an old spring mattress in an incinerator and be done with it; you have to physically separate the individual components first.

Because of the difficulties in recycling spring mattresses, there has developed a "refurbishing" industry where companies take old mattresses, remove the old cover, put on a new cover and resell the mattress. Unfortunately, there are a number of unscrupulous operators who sell these "used" mattresses as new. In addition, the price of steel, even the recycled steel that makes up the bulk of springs, is a limited resource and, as such, will only be going up in the future. Thus, there are many problems with coil mattresses.

Applicants' invention, on the other hand, mimics the usefulness of the spring system without the end-of-life problems. A foam mattress does not require expensive steel. Foam mattresses are also easily recycled, as they are merely run through a shredder and the shredded foam can be used for a wide range of products.

Foam mattresses are not new. The prior art has many foam mattress made by traditional methods, but none of them can match the performance of Applicants' invention. The current method of making a foam mattress is to use "slab stock foam" to make a base for the mattress. Slab stock foam can be inconsistent. It is made in huge "loaves" 100' long and four to six feet high. As with a loaf of bread, when you pour all that plastic into a mold and let it "rise" into foam there will be pockets of greater and lesser density, air holes, etc. The slab stock foam is then sliced into slabs the size of the mattress, and laid down as the bottom layer, but the manufacturer has little idea about the quality of the slab.

Slab stock foam also can be of poor quality with respect to its resilience, as one of its purposes is to add height to the mattress. While most slab stock foam has a density of around 1.5 to 1.8 pounds/square inch, Applicants' invention is made such that their foam has a density of 3.8 pounds/square inch. In addition, every time foam is cut, it loses some resiliency. In short, slab stock foam is a less than desirable substitute for metal springs in terms of providing resiliency to a mattress.

Above the slab stock bottom, there are a number of ways that foam mattress manufacturers try to make the mattress more resilient. This includes adding additional layers of foam, or adding individual cones that are glued in place. While these cones do provide some resiliency, they represent only about 30% of the mattress, thus many foam mattress are using less than a third of their height to provide comfort to the user.

There exist mattresses made of foam where different elements have different configurations such that certain portions of the mattress and be firmer or less firm than other regions of the mattress. However, these mattresses are generally manufactured in a manner not all the more efficient than building springs of different compressibility and manually inserting them into the mattress. The foam mattresses are generally created by taking small groups of 2 to 6 elements of different configurations and placing them onto a bottom portion with a perimeter, gluing them in place, the gluing a top layer over the top of the elements. While this method also accomplishes the goal of creating a mattress with different densities in different areas, it is difficult, expensive and time-consuming to create, and as with any process that involves human judgment, errors are always a possibility. Applicants' process, on the other hand, allows their core to be made with more accuracy so that the density is exponentially more consistent throughout the mattress. It is much easier to control density and consistency with a single mold and a single pour of foam into it, than it is to take slab stock foam and hope you are getting a consistent piece, then glue in some cones, hoping your employees put the right ones in the right part of the mattress, then glue over another piece of slab stock foam.

So, while the prior art has several examples of mattresses where different portions have different densities, all of this prior art is relatively expensive and requires significant time for the workers to put each mattress together.

Thus there has existed a long-felt need for a mattress that has different regions with different densities that can be manufactured inexpensively and efficiently.

The current invention provides a solution to these problems by providing a mattress core that is manufactured as a one-part item with cones of different shape and configuration offering a mattress core with different densities that needs no human effort other than operating the mold. The mattress as described in this provisional patent application can achieve this end through three separate means, which could also be used in combination:

1. Columns of different heights and shapes.
2. Columns with holes of different diameters.
3. Columns of different densities of foam.

A preferred embodiment of this invention is to have a single piece of foam manufactured in a single mold, such that the consistency of the foam can be easily monitored and controlled, with individual columns of different heights and shapes in different regions of the mattress core. Each column has a hole in the center, and the size of the hole will affect the resiliency of each column. The mattress core has side channels molded into it which help with air flow onto and out of the mattress. Because the air holes and the side channels are part of the mold, they do not have to be cut into the mattress after it is created, thereby decreasing the resiliency of the foam.

Because each column is molded in place, there is no need to individually glue in any cones—indeed no manual labor or glue is necessary as the mattress core comes out of the mold ready to use. With a single mold, a higher quality and density of foam can be used, thus Applicants' mattress core mimics the comfort of a spring mattress such as a pocketed coil mattress without any of the recycling/disposal problems. Because the entire core is made of the same quality of foam, the entire unit provides comfort as opposed to a traditional foam mattress where 70% is intended to giving the mattress height and only 30% designed toward the comfort of the user.

In addition, because this invention uses a single mold, it is possible to "zone" the mattress core to allow for different support characteristics in different portions of the mattress, as opposed to the prior art which requires a manufacturer to glue different cones into different areas.

SUMMARY OF THE INVENTION

It is a principal object of the invention to provide a mattress that can be manufactured as a single unit with different regions having different densities.

Other objects of the invention include:

having the mattress be manufactured out of a single mold, with no construction time and effort needed to create it other than overseeing the molding process—in other words, no time to take individual cones or small groups of cones and glue them into position, having different parts of the mold create columns of different size and shape such that they each cone imparts to the mattress core a different density and resilience, having different sized holes in the middle of the cones such that each cone imparts to the mattress core a different density and resilience, creating a mattress core without doing any foam cutting to create it, being able to use a higher quality and density of foam than is currently used in traditional foam mattresses, having side channels molded into the mattress core as opposed to being cut by hand or machine, and, having different densities of foam inserted into different parts of the mattress to create regions with different density and resilience through a multi-nozzle pour system.

It is a final object of this invention to provide method of making a mattress core with different densities at different parts of the mattress through the creation of a single mold with individual cones within that mold having different shapes, where the different shapes result in cones of different densities.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
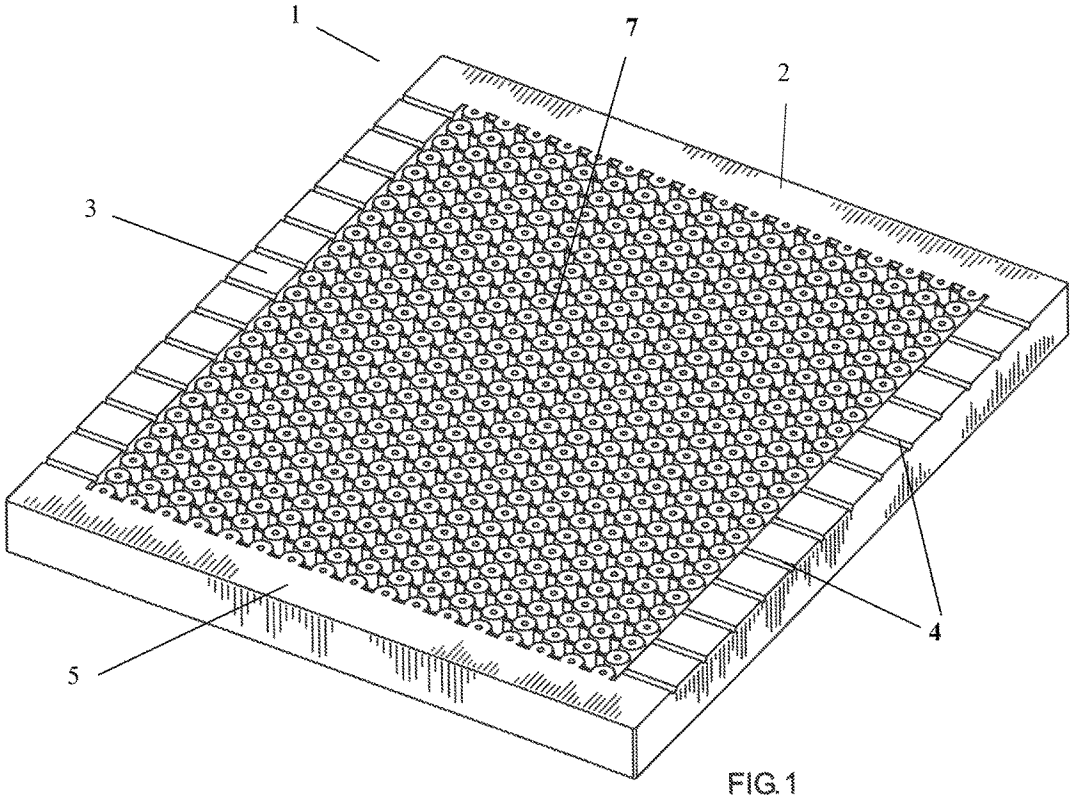
FIG. 1 is a perspective view of mattress with the individual columns in a straight-line configuration.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a perspective view of mattress with the individual columns in a straight-line configuration. The mattress, generally referenced as 1, has a main mattress body 7 that is bounded on the top by a top edge 2, bounded on the bottom by a bottom edge 5, and on the sides by two side edges 3. In the side edges are side channels 4, which allow air to flow into and out of the main mattress body 7. Because these side channels are molded into the mattress core, there is no loss of resiliency as is the case where side channels are cut into the foam. The main mattress body is made up of many columns, which are attached to the base of the main mattress body and manufactured as part of a single unitary constructed mattress body. With columns (reference number 6 in later figures) of different height, shape, and density, the goal of the invention is to create a mattress core with different densities in different parts of the mattress core without having to "put together" the mattress from assorted parts, but instead, to create the mattress as single foam body.

Figure 2:
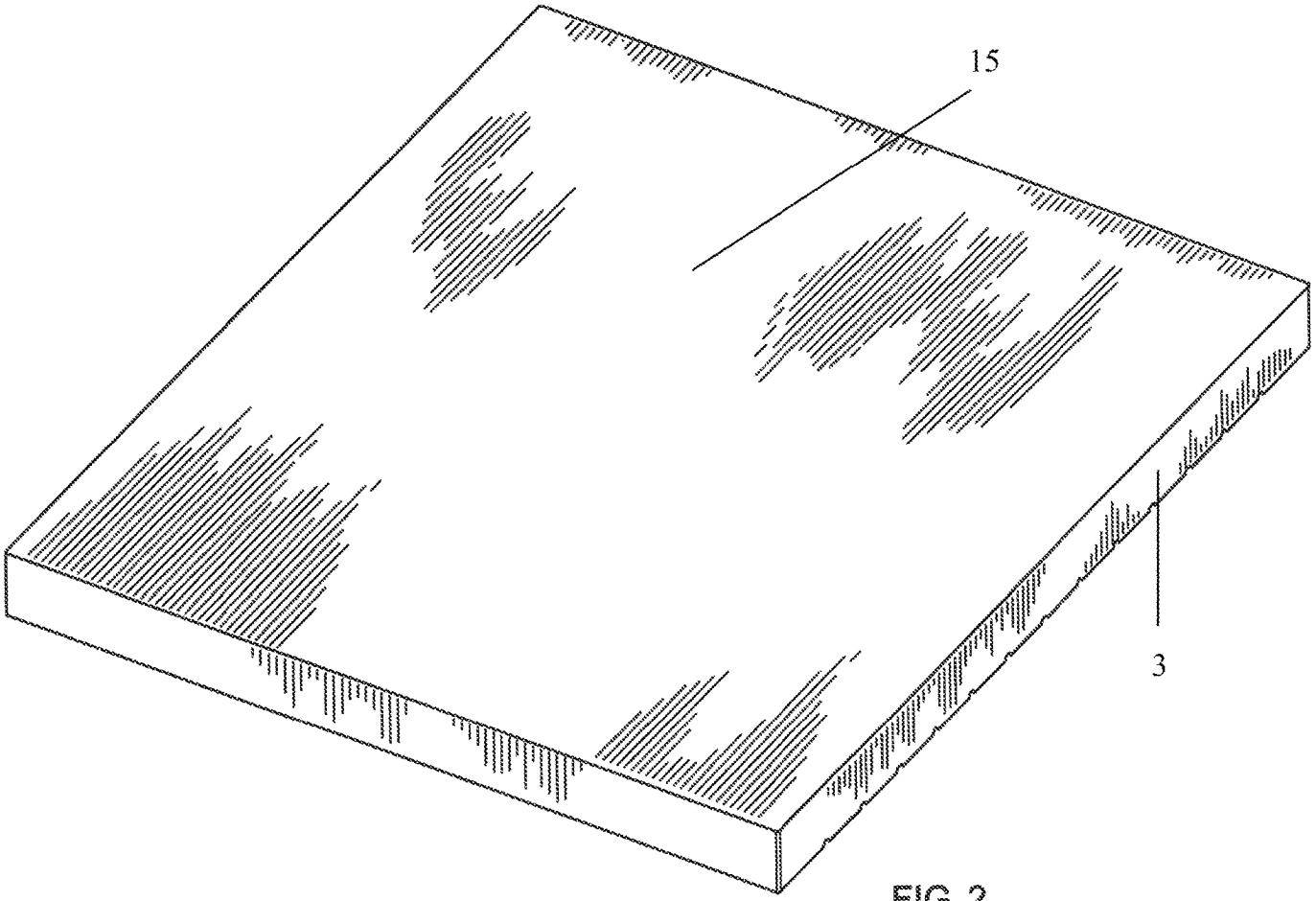
FIG. 2 is a perspective view of the bottom of a mattress core as described in this patent application, showing the "solid" version. There is a second version, where the hole in the column extends all the way through the mattress. This is illustrated in FIGS. 9-13.

FIG. 2 is a perspective view of the bottom 15 of a mattress core as described in this patent application. The bottom is flat.

Figure 3:
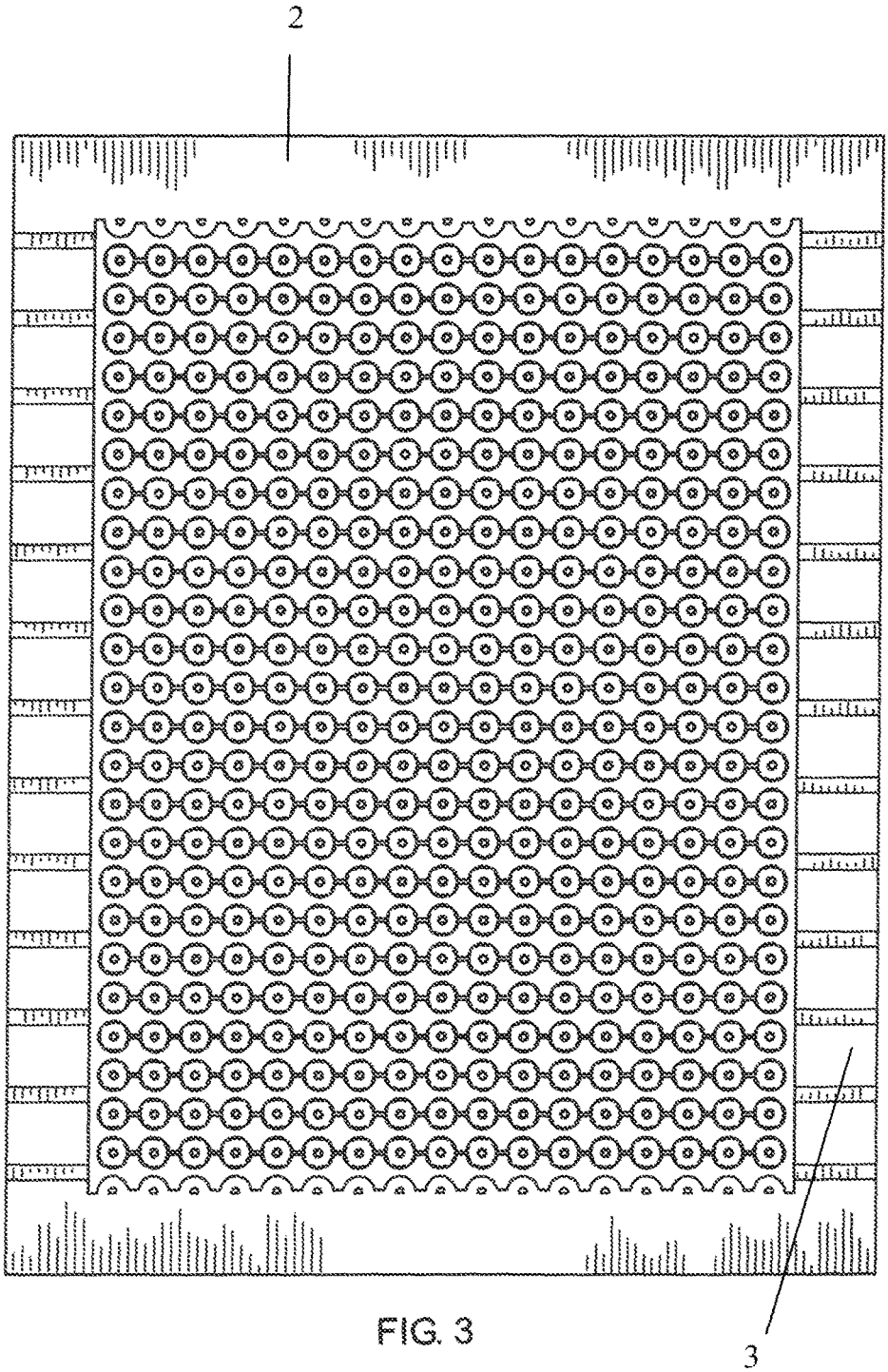
FIG. 3 is a top view of a mattress with the individual columns in a straight, in-line configuration.
Figure 4:
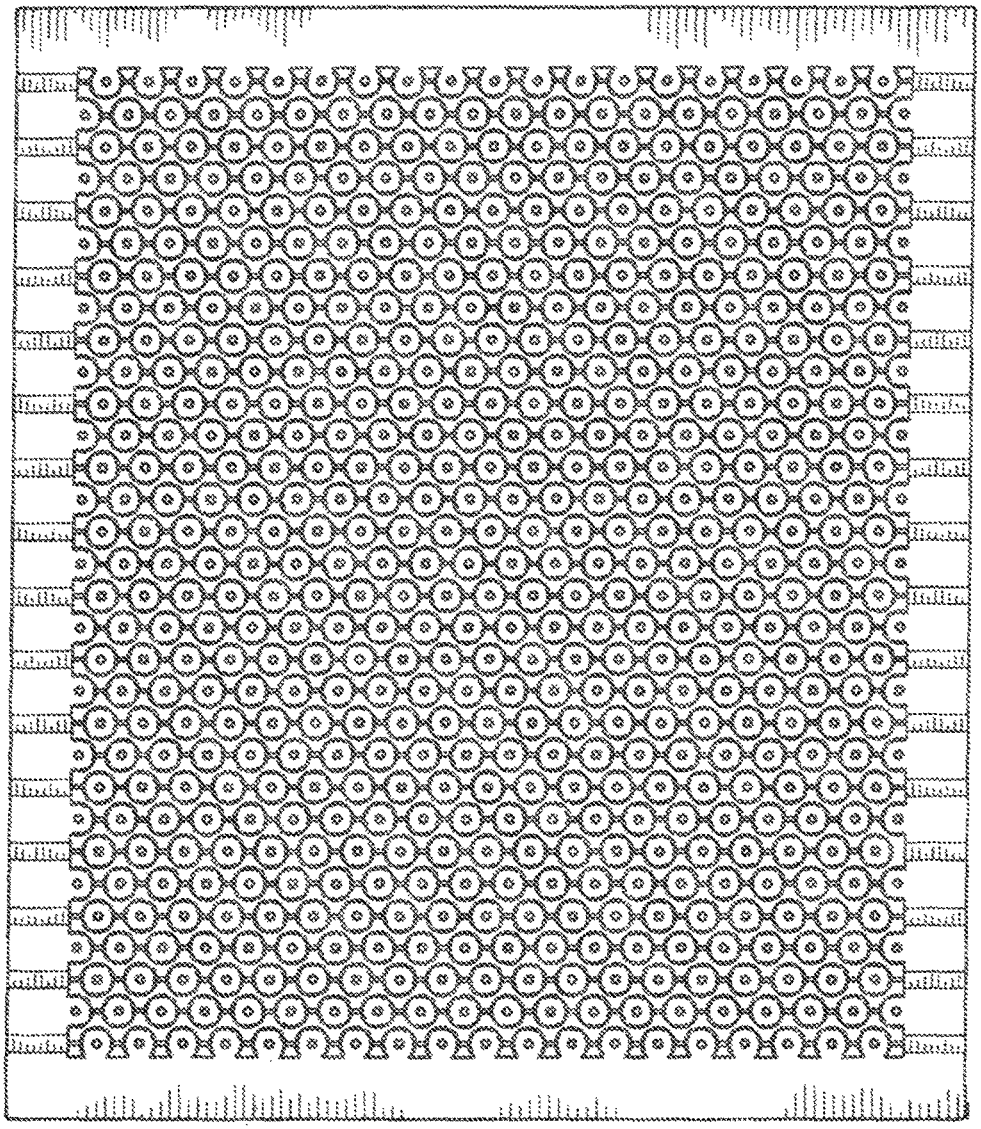
FIG. 4 is a top view of a mattress with the individual columns in a staggered configuration.

FIG. 3 is a top view of a mattress with the individual columns in a straight, in-line configuration, and FIG. 4 is a top view of a mattress with the individual columns in a staggered configuration. These alternative alignments can be used to affect different performance characteristics.

Figure 5:
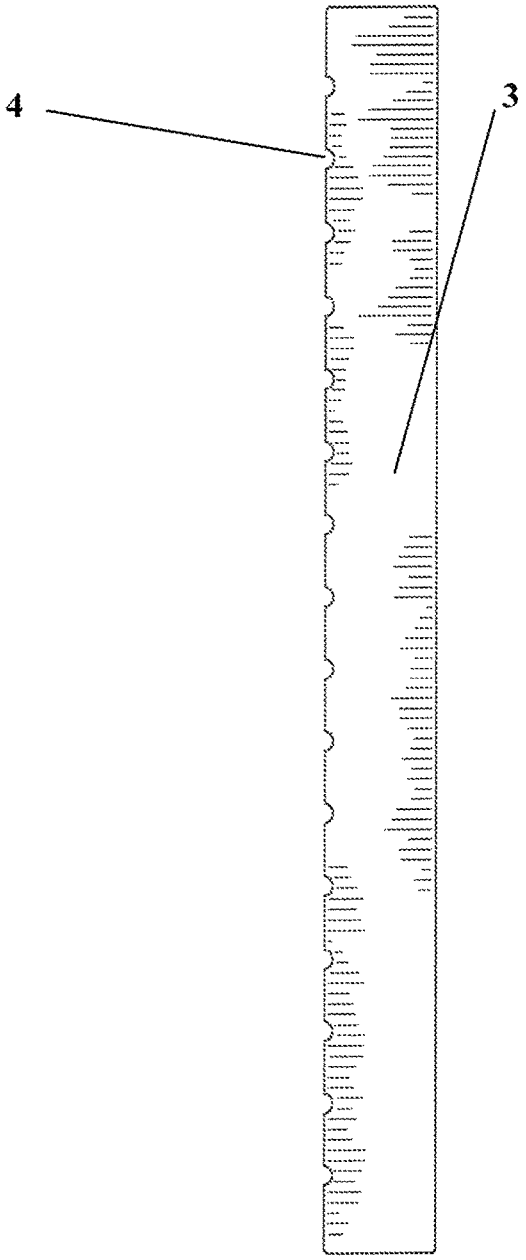
FIG. 5 is a side view of the mattress showing the side channels that allow for air to enter and exit the main mattress body.

FIG. 5 is a side view of the mattress showing the side edge 3 and the side channels 4 that allow for air to enter and exit the main mattress body.

Figure 6:
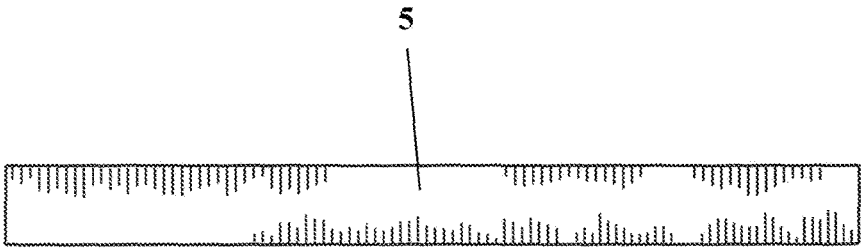
FIG. 6 is an end view (either top or bottom) showing the lack of side channels.

FIG. 6 is an end view (either top or bottom) showing the lack of side channels.

Figure 7:
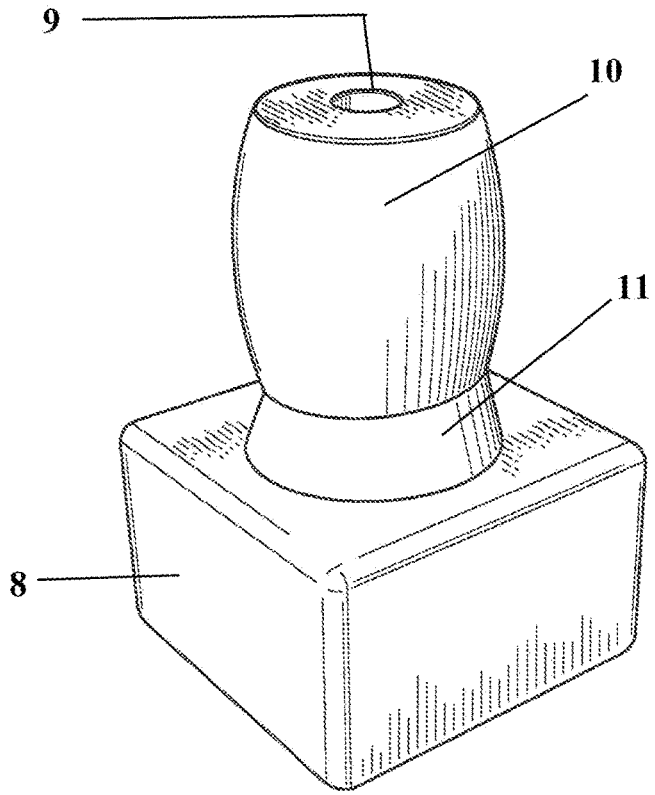
FIG. 7 is a perspective view of an individual column, showing the foot portion (that is part of a continuous mattress body) and the head portion that sticks up in the air.
Figure 8:
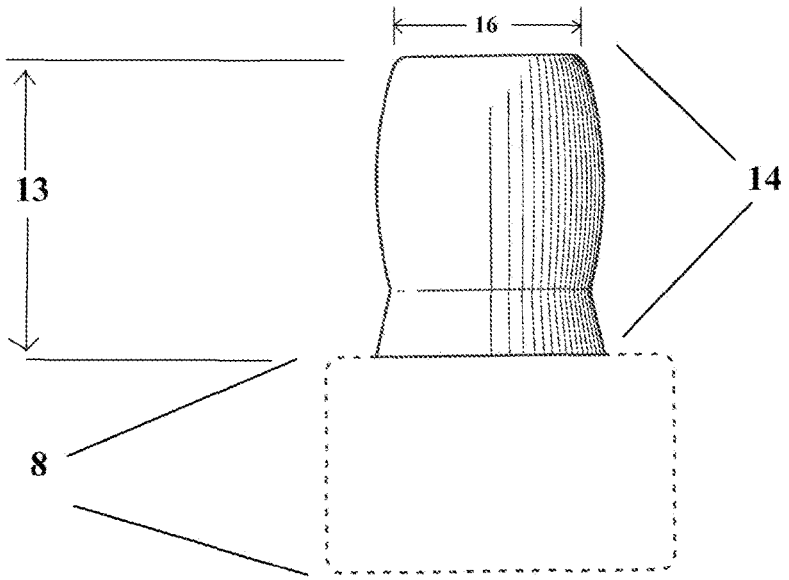
FIG. 8 is a front view of an individual column.
Figure 9:
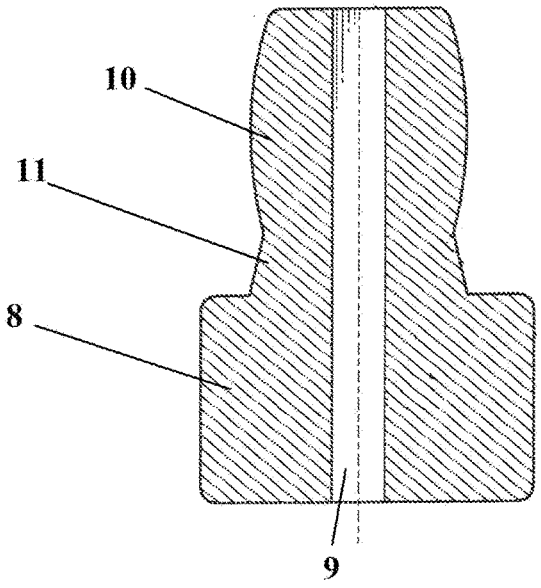
FIG. 9 is a cross sectional view of an individual column, showing the "solid bottom" version of the invention where the hole in the column does not extend through the bottom of the mattress.

FIG. 7 is a perspective view of an individual column, showing the foot portion 8 (that is part of a continuous mattress body) and the head portion 14 that sticks up in the air. FIGS. 8 and 9 are cross sectional views of an individual column, showing the foot 8 and the head portion 14. The head portion 14 has a hole 9 in the center. The diameter of the hole 9 can be enlarged to create a column with lower resiliency, or decreased to create a column with increased resiliency. Because the hold is in the mold, it does not have to be cut by hand or machine, thereby not losing any density or resiliency. The head portion also has a bulb 10, which is an enlarged section, and a base 11, which transitions from the bulb 10 to the foot 8. It should be noted that foot 8 extends the entire area of the main mattress body, and all columns are manufactured as part of the mattress. The head portion also has a height 13 and a width 16, which can be varied between columns to provide different amounts of resiliency.

It can be seen from this view how by increasing the height, widening the bulb 10, making the bulb 10 from a denser foam, or decreasing the diameter of the hole 9, it would be possible to create individual columns with different densities. Creating a mold where all the columns in a certain region of the mold are similarly designed, it can be seen how the invention can be manufactured such that each section could have a different density and resiliency.

Figure 10:
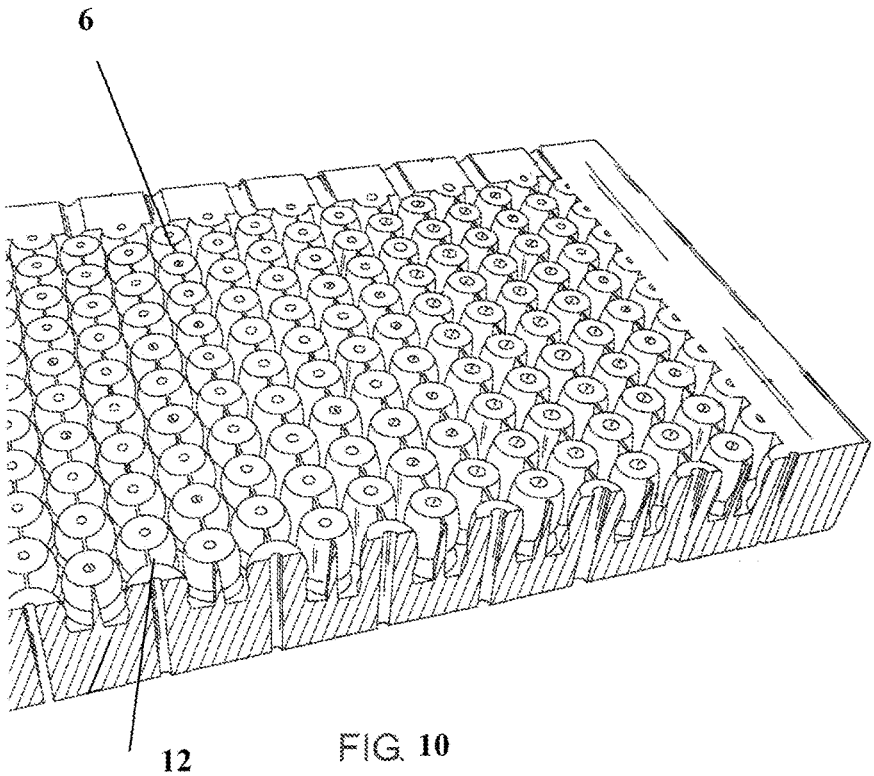
FIG. 10 is a perspective cross-sectional view of the main mattress body showing how a number of columns are formed with one mold.

FIG. 10 is a perspective cross-sectional view of the main mattress body showing how a number of columns are formed with one mold.

Figure 11:
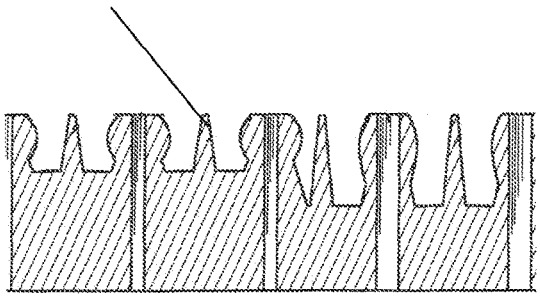
FIG. 11 is a cross sectional view of a main mattress body showing how the connectors connect the columns to each other in the "solid bottom" version of the invention.

FIG. 11 is a cross sectional view of a main mattress body showing how the connectors 12 connect the columns 6 to each other. The connectors serve to anchor the columns from moving too much laterally.

Figure 12:
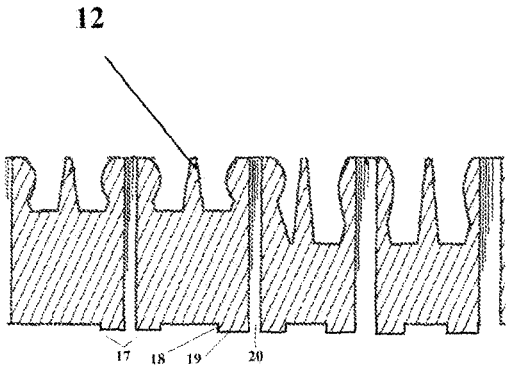
FIG. 12 is a cross sectional view of a main mattress body showing how the connectors connect the columns to each other in the version of the invention where the holes go all the way through the column, through the mattress bottom.

FIG. 12 is a cross sectional view of a main mattress body showing how the connectors connect the columns to each other in the version of the invention where the holes go all the way through the column, through the mattress bottom. The part of each column section protruding from the plane of the bottom of the mattress is called a "foot" 17. The foot 17 has a foot side 18, which gives it a certain foot height, and a foot top 19, which gives is a certain foot width. In the center of the foot 17 is a foot hole 20, which extends up through the column to the top of the mattress.

Figure 13:
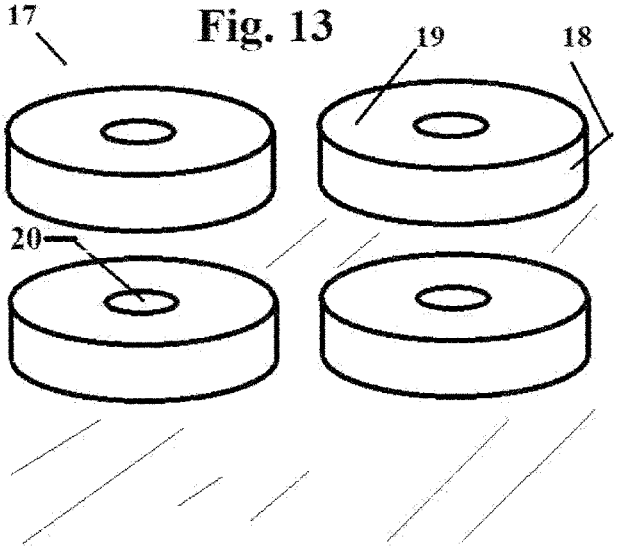
FIG. 13 is a perspective view of the bottom of a mattress in the embodiment of the invention where the holes go all the way though the mattress bottom.

FIG. 13 is a perspective view of the bottom of a mattress in the embodiment of the invention where the holes go all the way though the mattress bottom. Each foot 17, has a foot hole 20, through which air can rush as the mattress is being compressed by a person laying down on it. The height of the foot side 18 can be adjusted to accommodate different weights and desired compression characteristics.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A mattress core, comprising a top edge, a bottom edge, two side edges, where the top edge, bottom edge and side edges are joined at approximately a 90 degree angle to one another, a mattress bottom, and a mattress main body, where the mattress main body is bounded by the top edge, the bottom edge and the two side edges, and where the mattress body additionally comprises at least two columns, where the at least two columns have a head and a foot, where the foot is a continuous piece of foam extending the entire mattress body, and the head is bounded by air on at least 75% of its diameter and extends vertically from the mattress body, where the mattress core is a single piece of foam and where each one of the at least two columns additionally comprises a hole that extends throughout the column, where the side edges additionally comprise side channels which enhance the flow of air into and out of the mattress core, where the mattress bottom additionally comprises one or more foots, where each of the one of more foots is a bottom portion each of the one or more columns, and where each foot has a foot top and a foot side, where the foot side is a cylinder extending around the foot, and where the foot top is a flat surface, and a foot hole, where the foot hole is a cavity extending from the foot top through the column, and where each foot has a foot spacing, which is the distance between a particular foot and an adjacent foot.

2. The mattress core of claim 1, where the head additionally comprises a bulb and a base, where the bulb is a roughly cylindrical shape and has a top diameter, a middle diameter, and a bottom diameter, where with a middle diameter is larger than both the top diameter and the bottom diameter, and where the head has a density, a height, and a width.

3. The mattress core of claim 2, additionally comprising a connector, where the connector comprises a ridge of foam with a length longer than a width.

4. The mattress core of claim 3, where the connector bridges at least one column to another column or to the top edge, bottom edge or side edges.

5. The mattress core of claim 4, where at least one at least two columns has a difference from at least another column of the at least two columns.

6. The mattress core of claim 5, where the difference is differences in density of the foam used to create the two heads.

7. The mattress core of claim 5, where the difference is different diameters of holes in the head.

8. The mattress core of claim 5, where the difference is different shapes of the at least two columns.

9. The mattress core of claim 5, where the difference is different heights of the at least two columns.

10. The mattress core of claim 5, where the difference is different widths of the at least two columns, and different spacing between one or more of the at least two columns.

11. The mattress core of claim 5, where the difference is different heights and different widths of at least two of the at least two columns.

12. The mattress core of claim 5, where the difference is different densities and different heights and different widths of at least two of the at least two columns.

* * * * *